United States Patent [19]

Jones

[11] 3,998,454

[45] Dec. 21, 1976

[54] FORCE RECEIVING EXERCISING MEMBER

[76] Inventor: Arthur A. Jones, Lake Helen, Fla. 32744

[22] Filed: Sept. 17, 1974

[21] Appl. No.: 506,795

Related U.S. Application Data

[60] Division of Ser. No. 360,590, May 15, 1973, Pat. No. 3,858,873, which is a continuation of Ser. No. 172,478, Aug. 17, 1971, abandoned.

[52] U.S. Cl. ..... 272/117

[51] Int. Cl.[2] ..... A63B 21/00

[58] Field of Search ..... 272/81, 57 D, 71, 73, 272/117, 118, 93, 128, 144, 116; 128/25 D

[56] References Cited

UNITED STATES PATENTS

| | | | |
|---|---|---|---|
| 684,688 | 10/1901 | Herz | 272/81 |
| 3,475,024 | 10/1969 | Lewis | 272/81 |
| 3,640,527 | 2/1972 | Proctor | 272/81 |

FOREIGN PATENTS OR APPLICATIONS

| | | | |
|---|---|---|---|
| 495,945 | 2/1938 | United Kingdom | 272/73 |
| 215,774 | 7/1968 | U.S.S.R. | 272/81 |

*Primary Examiner*—Richard C. Pinkham
*Assistant Examiner*—William R. Browne
*Attorney, Agent, or Firm*—Karl W. Flocks

[57] ABSTRACT

A force applying member for use in an exercising machine wherein the member includes a pair of generally L-shaped levers. A first leg of one L-shaped lever is parallel to a first leg of the other L-shaped lever and a second leg of one L-shaped lever extends generally parallel to a second leg of the other L-shaped lever. A member is attached to the first legs for receiving a force applied by a user. The latter member is adjacent the intersection of each of the first and second legs of each L-shaped lever. There is an angled portion on each of the second legs at an end away from the respective intersections of said first and second legs and a transversely extending stabilizing bar connecting the angled portions and having a clearance therebetween. Each first leg has a rotatable hub member integrally extending from one end thereof.

3 Claims, 14 Drawing Figures

FORCE RECEIVING EXERCISING MEMBER

This is a division of application Ser. No. 360,590, filed May 15, 1973, now U.S. Pat. No. 3,858,873; which is a continuation of Ser. No. 172,478, filed Aug. 17, 1971, now abandoned.

BACKGROUND OF THE INVENTION

This invention is the outgrowth of applicant's many years of experience and research in the field of body building with emphasis being placed upon considerations of muscle and body physiology and basic physics of exercise methods and the realization of the need for tailored machinery for specific structure and function of individual muscles. While existing exercises and machines may be competent in developing the body, it is not clear that they are necessarily the ultimate in point of efficiency. In this connection most, if not all, conventional exercising machines are based upon the effect of gravity providing a linear resistance or force against which the individual works to build his body. Spring machines are comparable to the effect of gravity in that the resistance thereof are linear or unidirectional. Even in machines having pulleys the pulleys serve only to re-direct the direction of the resistance to a single linear direction.

The fact that in conventional exercises resistance to body movement is linear is a significant drawback particularly when the body parts involved are rotating. In other words the rotary motion of body parts is countered by reciprocatory motion which is linear. The benefits to be derived therefrom, because of the relatively low efficiency of such system or exercise, is forthcoming only after prolonged and unnecessary effort as will be seen from the machine and method disclosed and claimed herein by applicant.

DISCUSSION OF THE PRIOR ART

A simple and well known form of body building exercise is the curl, the movement of which is rotational throughout a range of movement of approximately 160°. At the start of a curl, the movement is almost perfectly horizontal, straight forward; approximately midway through this exercise the movement is vertical, straight up; and at the end of the exercise the movement is approximately horizontal again, but in the opposite direction. During the entire movement of this exercise, the resistance is always vertical in a straight down direction. From this it is seen that although the resistance remains constant, it would seem to become heavier as the movement progresses from the starting position to the midpoint and seem to become lighter thereafter. In the normal finishing position of the curl, there is literally no resistance. At this point it is possible to hold that position almost indefinitely, with absolutely no work being demanded on the part of the bending muscles of the upper arms. This occurs because during a curl the moment arm of the weight is constantly changing as the movement progresses with direct resistance being provided only at the infinitely small point where resistance is being moved vertically. A close study of conventional exercising machines will clearly show that in almost every case direct resistance is provided only within an extremely limited range of movement, literally an infinitely small range of movement, and that in many conventional machines there is no direct resistance at any point.

If the normal strength generated by human muscles involved exactly match the apparently changing resistance provided by an exercise such as the curl, then the movement would feel perfectly even, that is, the resistance at no point over the range of movement would appear to be any heavier than that at any other point. However, since in fact the strength generated by the muscles does not match a change in resistance, the resistance at some points does feel heavier than at other points; so-called "sticking points" are encountered, where the weights feel very heavy. Along with this there will be points where there is little or no resistance to the movement of the resistance.

SUMMARY OF THE INVENTION

The present invention relates to an exercising member that is adapted to be rotatably mounted in a frame. The member is adapted, when positioned in an exercise frame, to be acted upon by a user so as to move a load that resists rotation of the member.

BASIC EXERCISING CONCEPT

Figure 1A:
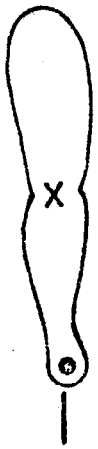
FIGS. 1A–E show a sequence of arm positions in a curl exercise.

Looking at FIGS. 1 A–E which show a sequence of arm positions during a curling exercise, it is seen in FIG. 1A, which shows the initil position of the exercise, that the lower arm is in line with the upper arm and therefore produces zero moment about X which marks the pivot point between the upper and the lower arms. As the arms progress to the positions as shown in FIGS.

1B–D moment arms of 8 inches, 12 inches, and 6 inches, respectively, are effected about the pivot point X. Finally, when the arms are at the end of the exercise as shown in FIG. 1E, there is again zero moment arm about the pivot point X since the weight at the end of the lower arm is once again in vertical alignment with the pivot point X.

Figure 1B:
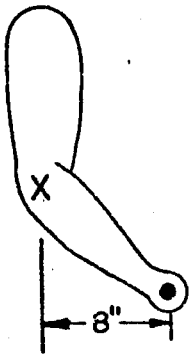
Figure 1C:
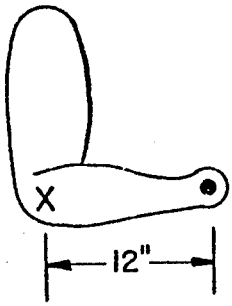
Figure 1D:
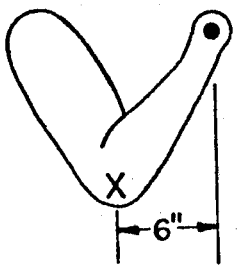
Figure 1E:
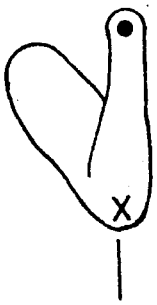

It is important to note in the curl exercise that it is the muscle in the upper arm attached to the lower arm which provides the motive power to move the lower arm and raise the weight carried at the end of the lower arm. Looking again at FIG. 1A it is obvious that there is literally no resistance at the start of a curl, because there is zero distance between the two vertical lines and thus zero moment arm. As the lower arm proceeds to the 45° position as shown in FIG. 1B, the moment arm has increased from zero to approximately eight inches. Assuming that the exerciser is using a 100 lb barbell, the torque has increased from zero to 800 inch-pounds about the pivot point X. When the arm has moved another 45° in the exercise as shown in FIG. 1C, the moment arm has increased to approximately twelve inches and the torque has reached its highest point of 1200 inch-pounds. As the lower arms move forward another 45° as shown in FIG. 1D, the moment arm decreases to approximately 6 inches to provide a torque of 600 inch-pounds about the point X. Finally, when the lower arm moves to the vertical position as shown in FIG. 1E, there is once again zero moment arm about the point X which produces zero torque. It is noted in FIGS. 1D and 1E that the elbows have moved forward substantially from the position as shown in FIGS. 1A–C so that the upper arms are no longer in a vertical line, this is because during an actual barbell curl, the elbows do not remain fixed in one position and this further results in a quicker reduction of moment arm and therefore torque after the 90° position shown in FIG. 1C has been reached.

From the above discussion it is clearly seen that much of the muscle fibers of the upper arms are not called upon to do any work during the curling exercise and that at certain points none of these muscles are called upon to do any work.

DESCRIPTION OF THE PREFERRED EMBODIMENT

Referring now more particularly to FIGS. 2–10 of the drawings, the novel exercising machine according to this invention is in the form of a pull-over machine which comprises a frame 10 having a pair of parallel front legs 12 extending upwardly and to the rear. Each of the front legs 12 includes a rearwardly directed, angled extension 14. Extending transversely of the machine is a bar 15 which is integral with the ends of extensions 14 to provide rigidity to the frame 10 thereat. Approximately midway between the bottom of each of the front legs 12 and the intersection point of the extension 14 with the front legs 12 is a downwardly and rearwardly extending rear leg 16. A horizontal bar 18 connects each of the front legs 12 to a rear leg 16 to provide the frame with rigidity. A generally vertically extending bar 20 connects each of the angled extensions 14 to a rear leg 16 to provide additional rigidity to the frame 10. Extending generally parallel to and above each of the bars 18 is an upper bar 22 integral with a front leg 12 and a rear leg 16. Integral with each of the bars 18 is a transversely extending horizontal bar 24. Extending rearwardly from the midpoint of the transversely extending bar 24 to opposite bars 18 is a pair of diagonal bars 27.

Interposed within the frame 10 and secured thereto is a generally L-shaped seat supporting member 26 to which is fixedly secured a seat member 28 and a back rest 29. A loud or resistance weight tray assembly 30 includes a pair of parallel arms 32 extending forwardly therefrom to each of the front legs 12 which are pivotally secured thereto by pins 34. The tray assembly 30 includes a pair of parallel weight retaining posts 36 which are adapted to pass through perforated load or resistance weight members 38 which are removably held thereby. Additional load or resistance weight members may be added thereto if desired. Fixed to the underside of the weight tray assembly 30 and midway between posts 36 is a generally U-shaped rail element 39. Extending rearwardly from the weight tray assembly 30 is a pair of brackets 40 each of which supports a bearing post assembly 42 for a pair of rotatable lifting pulleys 43 which are substantially in the same plane. A pair of parallel redirectional pulleys 44 are rotatably supported adjacent the free end of the extensions 14 by pins 46 and brackets 48. A pair of parallel spiral pulleys 50 each having a plurality of spokes 52 and a hub 54 integral therewith are rotatably supported at the top of front legs 12 and adapted to rotate about the axis of pins 56. A cable 58 having its opposite ends fixedly connected to the surface of the spiral pulleys 50 and adapted to be wound and unwound thereover extends over the re-directional pulleys 44 and under the pulleys 43. Integral with each hub 54 and extending radially therefrom is a connecting rod 55 having a counterweight 57 at the free end thereof. Also integral with each of the hubs 54 is a generally L-shaped force applying lever assembly 60 having one leg 62 extending radially from the hub 54 and a leg 64 having a free end. The free end of each leg 64 has a reversely extending angled portion 66 which ultimately extends transversely of the machine as a stabilizing bar 68 integrally connecting opposite angled portions 66 and providing a deformed clearance therebetween. Extending outwardly from and fixed to the free end of each of the legs 62 of the L-shaped lever adjacent the intersection of leg 62 with leg 64 is a bracket 70. An elbow pad 72 constituting force receiving means is secured to each bracket 70.

Integral with and extending down from the bottom of seat support 26 is a yoke 74 on which is pivotally secured a treadle 76 by pins 78. The treadle 76 has an angled front extension 80 through which extends a transverse bar 82. At the rear end of the treadle 76 is an abutment member 84 adapted to contact rail 39. A two-piece seat belt 86 is fixed to each bar 22 by pin 28.

Figure 2:
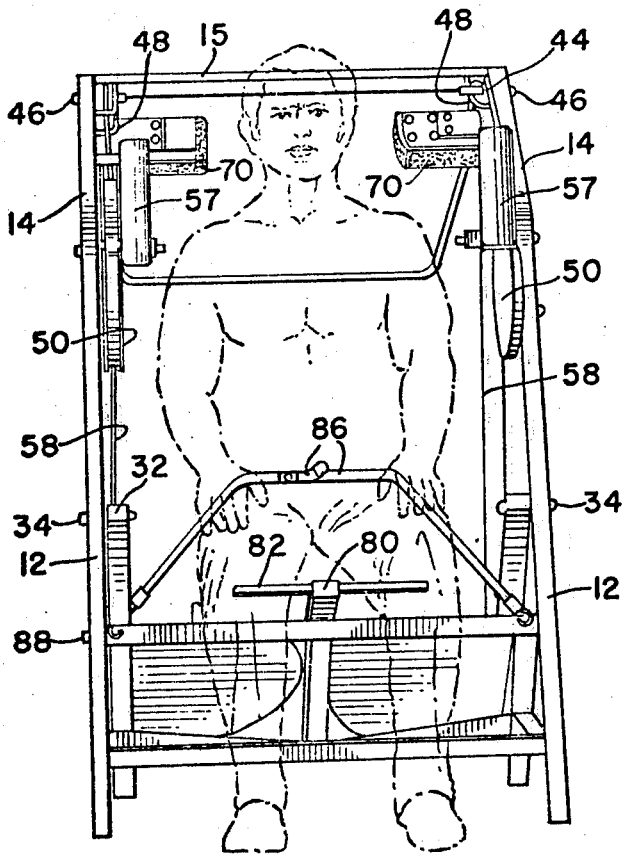
FIG. 2 shows a front elevational view of the machine according to this invention with an exerciser outlined in phantom as being seated on and strapped to the machine in an initial position prior to using the machine.
Figure 4:
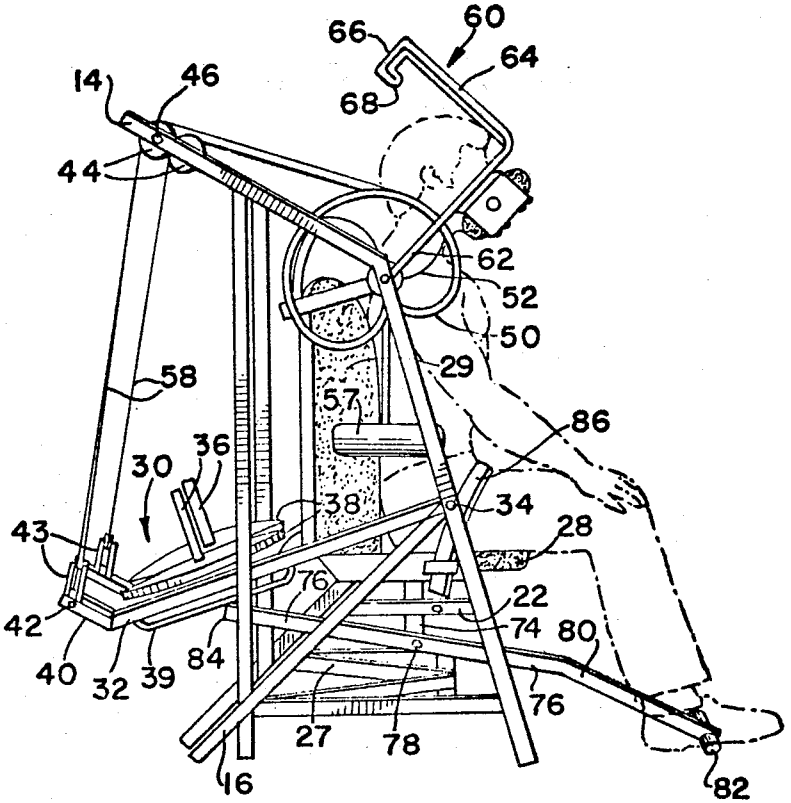
FIG. 4 shows a side elevational view of the machine according to this invention with the exerciser having adjusted the force applying lever to the position in which the body part to be exercised may be applied thereagainst by lowering the forward end of a treadle.
Figure 3:
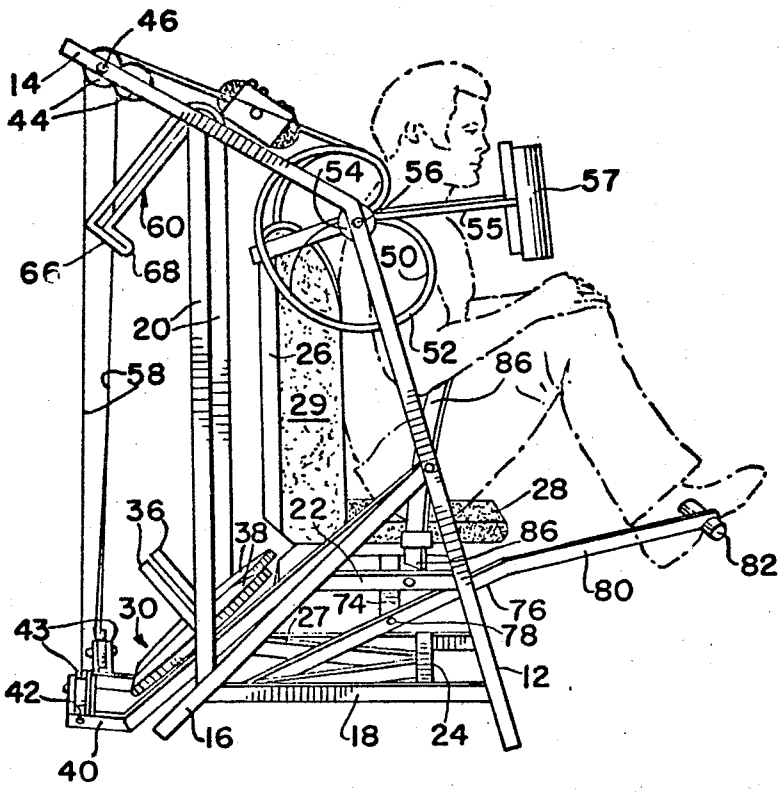
FIG. 3 shows a side elevational view of the machine according to this invention with the exerciser preparing to adjust the force applying lever to the position in which the body part to be exercised may be applied thereagainst.
Figure 6:
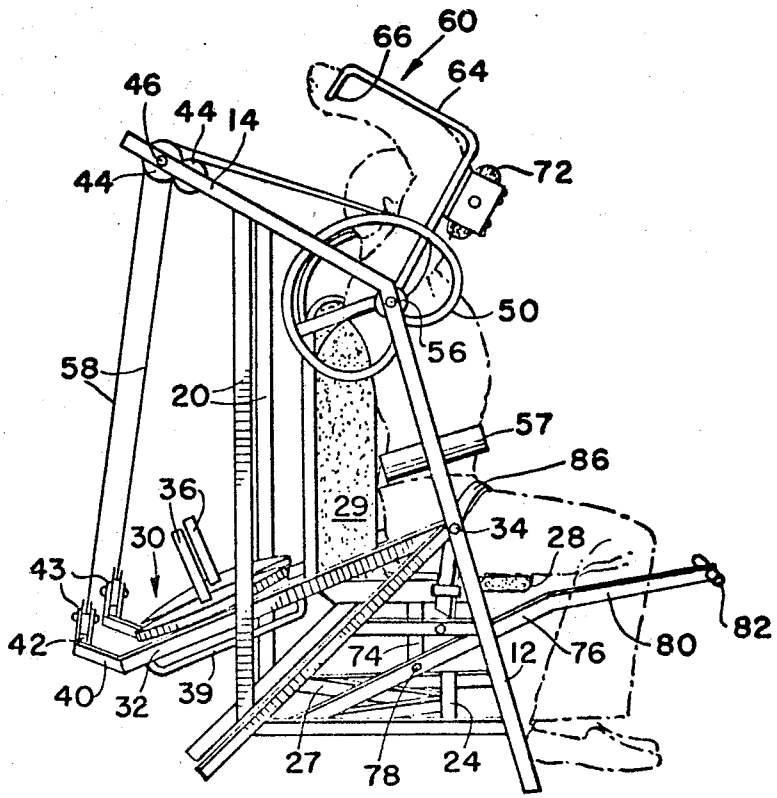
FIG. 6 shows a side elevational view of the machine according to this invention with the exerciser having removed his feet from the adjustment treadle.
Figure 5:
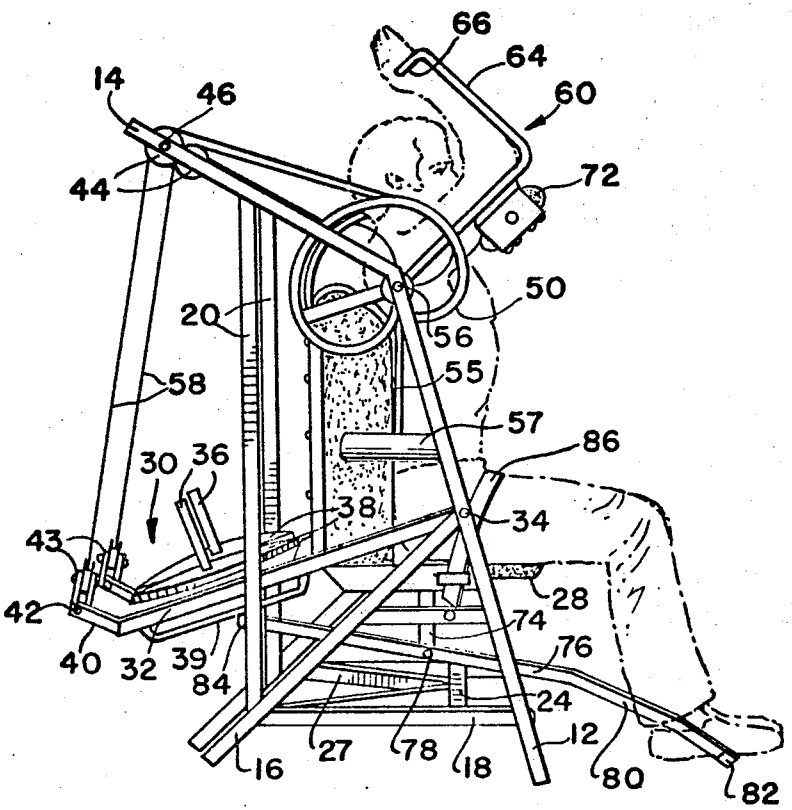
FIG. 5 shows a side elevational view of the machine according to this invention with the exerciser having placed the body parts to be exercised against the force applying lever.

To operate the machine 10 an exerciser first seats himself in the machine and straps himself thereto with two-piece belt 86 as shown in FIG. 2. At this time the force applying lever assembly 60 is up and behind the exerciser as best seen in FIG. 3. The exerciser then places his feet on the transverse bar 82 at the end of the front extension 80 of treadle 76 preparatory to raising the weight tray assembly 30. The exerciser then brings his feet to the ground to raise the load or resistance weight tray assembly 30 as the abutment member 84 at the rear end of treadle 76, which is pivoted at 78, is brought against the rail 39 at the underside of the weight tray assembly 30 as shown in FIG. 4. As the weight tray assembly 30 is raised to the position shown in FIG. 4, each counterweight 57 drops from the position shown in FIG. 3 to that shown in FIG. 4 thereby causing each spiral pulley 50 and force applying lever assembly 60, both of which are interconnected to the counterweight 57 by the hub 54 rotatably supported at the top of the front legs 12 by pins 56, to rotate in a clockwise direction to the position shown in FIG. 4. The exerciser may now place the elbow portion of his upper arms against the force receiving elbow pads 72 as shown in FIG. 5. For purposes of this exercise the upper arms are regarded as prime body parts and the shoulder area of each arm is considered as a prime body joint. Next, the exerciser removes his feet from the transverse bar 82 to allow the rear end of the treadle 76 to drop to the ground. At this point, the weight tray assembly 30 is suspended in mid air by virtue of the cable 58 which passes under the pair of pulleys 43, over the pair of re-directional pulleys 44 and is secured to the surface of spiral pulleys 50. Various positions of the force applying lever assembly 60 are now determined by the force applied thereto by the exerciser's upper arms in opposition to gravity pull of the weight tray assembly 30 as resolved by the spiral pulleys 50 along portions of cable 58 emanating from the surface of pulleys 50 in tension. It is noted here that the only force applied to the lever assembly 60 by the exerciser is at the elbow pads 72, which receive forces applied thereto by an exerciser. No force is applied to the leg 64 or at the angled portions 66 of the lever assembly 60 by the forearms and hands of the exerciser. The location of the forearms and hands are irrelevant as long as they do not interfere with the force applied by the upper arms. The principal function of the legs 64 is to provide a resting place for the forearms of the exerciser and to support the angled portions 66 which act as a handrest, which are interconnected by transversely extending stabilizer bar 68.

Figure 8:
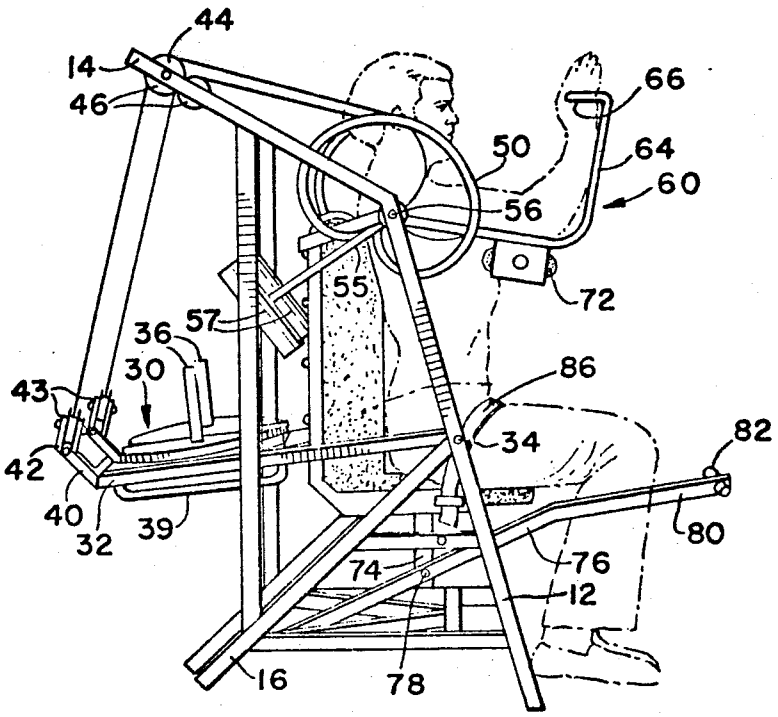
FIG. 8 shows a side elevational view of the machine according to this invention with the exerciser having moved his arms forward to about the midpoint of a cycle of exercise.
Figure 7:
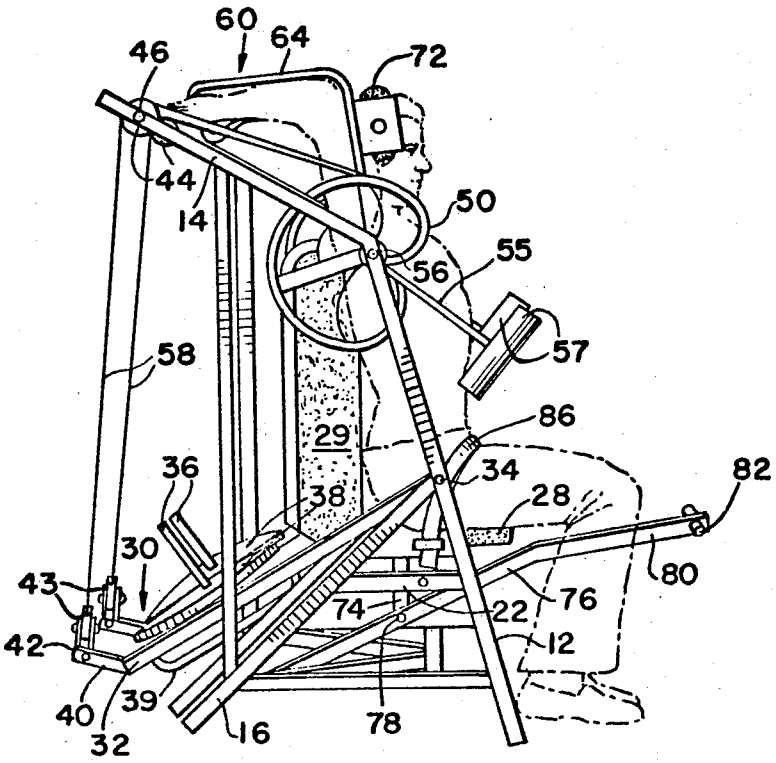
FIG. 7 shows a side elevational view of the machine according to this invention with the exerciser allowing his arms to move back to initiate a cycle of exercise.
Figure 10:
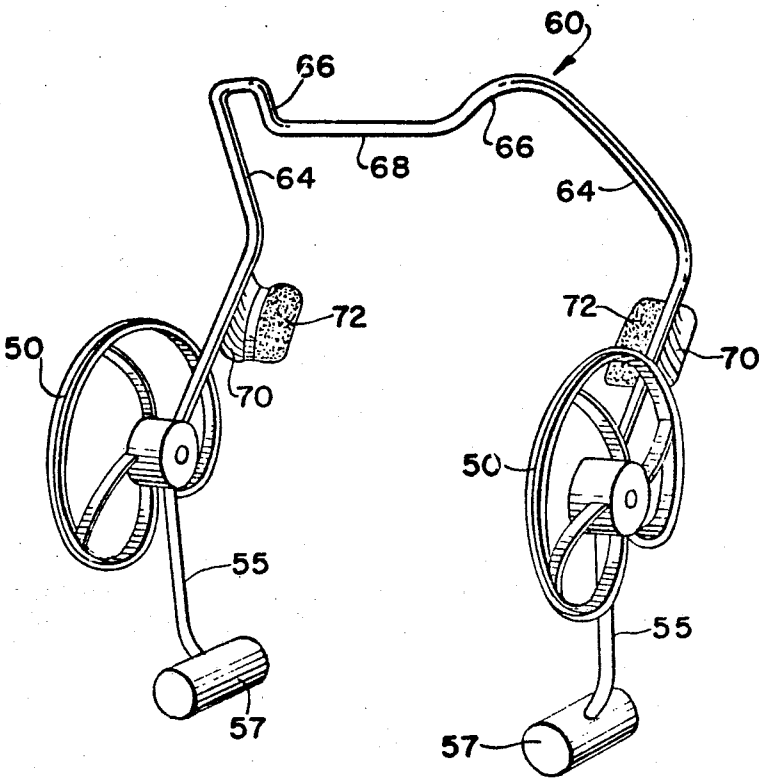
FIG. 10 shows a view in perspective generally from the rear of the force applying lever, resolving spiral pulley and counterweight assembly.

A complete cycle of exercise on the machine 10 is traversed by the exerciser as he allows his upper arms to swing back to the position shown in FIG. 7. The exerciser then brings his upper arms forward with FIG. 8 showing an intermediate position of the exercise and FIG. 9 the end of one cycle of the exercise. At the end of the exercise the stabilizing bar 68 extending from the angled portions 66 at the opposite ends thereof may be brought down over the exerciser's lap because of the deformed clearance provided thereby.

Figure 9:
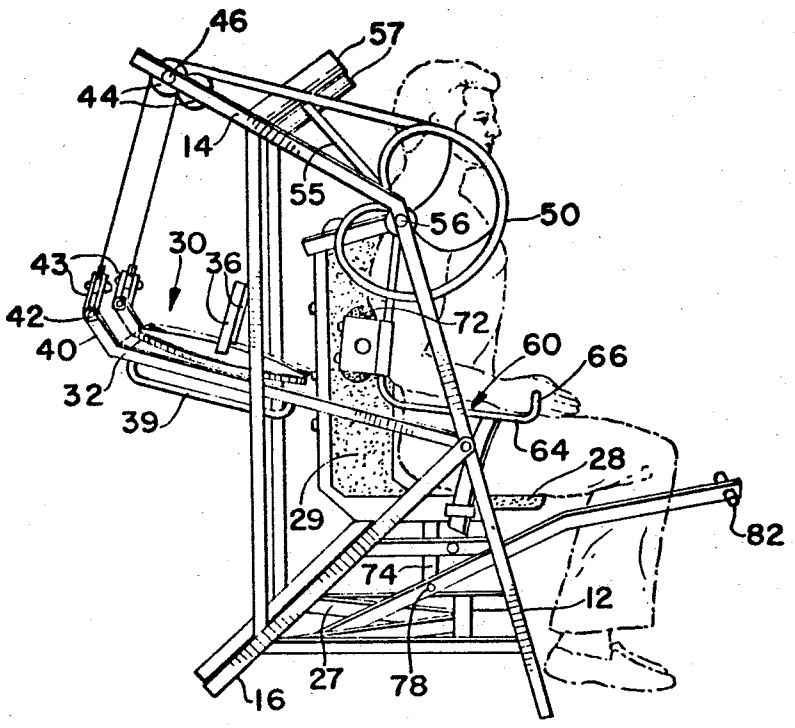
FIG. 9 shows a side elevational view of the machine according to this invention with the exerciser having brought his arms forward to the other end of the exercise cycle.

In each of FIGS. 7, 8 and 9 it is noted that the point of rotation 66 of each spiral pulley 50 is substantially in line with the shoulders of the exerciser at which the point of rotation of the exerciser's upper arms are located. Because of the configuration of each spiral pulley 50, the tension of the cable 58 with respect to the pulley is constantly changing as the pulley 50 is rotated between the position shown in FIG. 7 and that shown in FIG. 9. It is noted here that during an exercise the muscles are stronger in some positions thereof than in other positions. Because the strength of muscles varies as movement occurs during an exercise, resistance is correspondingly varied in accordance with this invention to provide a balanced resistance over the full range of the exercise. The exercising machine according to this invention thus provides an exerciser with a balanced resistance over the full range of a cycle of exercise, direct resistance to his efforts, and omnidirectional resistance to his efforts over the full range of the machine.

Although the machine as disclosed provides force applying lever assembly 60 for matching body parts, it is clear than an exerciser if he desires may exercise only a single body part.

It is to be understood that while one preferred embodiment of the present invention has been illustrated and described herein, numerous variations or modifications therein may occur to those having skill in this art and what is intended to be covered herein is not only the illustrated form of the invention, but also any and all modified forms thereof as may come within the scope and spirit of this invention.

What is claimed is:

1. A force applying member for use in an exercising machine comprising a pair of generally L-shaped levers each of which has a first leg extending generally parallel to a first leg of the other L-shaped lever and a second leg extending generally parallel to a second leg of the other L-shaped lever, force receiving means for receiving force applied in an exercise on each of said first legs adjacent the intersection of each of said first and second legs of each L-shaped lever, an angled portion on each of said second legs at an end away from the respective intersections of said first and second legs and a transversely extending stabilizing bar connected to said angled portions to define a clearance space, and each of said first legs of the L-shaped levers further including in combination therewith a rotatable hub member integrally extending from one end thereof.

2. A force applying member for use in an exercising machine comprising a pair of generally L-shaped levers each of which has at the end of one leg an integral angled portion and a transversely extending stabilizing bar connected to said angled portions to define a clearance space, with each of the other legs of the L-shaped levers including in combination therewith a rotatable hub member integrally extending from one end thereof and each of said hub members including a spiral pulley extending therearound and fixedly secured thereto.

3. The force applying member as defined in claim 2 wherein each of said hub members has extending radially therefrom a connecting rod with counterweight at the end thereof.

* * * * *